US009097262B2

(12) United States Patent
Tsukida

(10) Patent No.: US 9,097,262 B2
(45) Date of Patent: Aug. 4, 2015

(54) AXIAL FLOW FAN

(75) Inventor: Junji Tsukida, Kyoto (JP)

(73) Assignee: Nidec Corporation, Kyoto (JP)

( * ) Notice: Subject to any disclaimer, the term of this patent is extended or adjusted under 35 U.S.C. 154(b) by 406 days.

(21) Appl. No.: 13/562,480

(22) Filed: Jul. 31, 2012

(65) Prior Publication Data

US 2013/0045092 A1 Feb. 21, 2013

(30) Foreign Application Priority Data

Aug. 19, 2011 (JP) ..... 2011-179885

(51) Int. Cl.
*F04D 29/38* (2006.01)
*F04D 25/06* (2006.01)

(52) U.S. Cl.
CPC ..... *F04D 29/384* (2013.01); *F04D 25/0613* (2013.01)

(58) Field of Classification Search
CPC ..... F04D 29/384; F04D 25/0613
USPC ..... 415/220; 416/223 R, 243
See application file for complete search history.

(56) References Cited

U.S. PATENT DOCUMENTS

| | | | | |
|---|---|---|---|---|
| 4,063,852 | A | 12/1977 | O'Connor | |
| 5,244,347 | A * | 9/1993 | Gallivan et al. | 416/189 |
| 5,312,230 | A | 5/1994 | Oda et al. | |
| 6,544,010 | B1 | 4/2003 | Choi | |
| 6,616,409 | B2 * | 9/2003 | Bradbury et al. | 416/223 R |
| 8,157,518 | B2 * | 4/2012 | Decker et al. | 415/211.2 |
| 2003/0223875 | A1 * | 12/2003 | Hext et al. | 416/243 |
| 2004/0175269 | A1 * | 9/2004 | Cho et al. | 415/220 |

FOREIGN PATENT DOCUMENTS

| | | | |
|---|---|---|---|
| JP | 2-298695 | A | 12/1990 |
| JP | 09-68200 | A | 3/1997 |
| JP | 9-105396 | A | 4/1997 |
| JP | 2662028 | B2 | 10/1997 |
| JP | 2001-304195 | A | 10/2001 |
| JP | 2002-21798 | A | 1/2002 |
| JP | 2002-130188 | A | 5/2002 |
| JP | 2003-65293 | A | 3/2003 |
| JP | 2005-307788 | A | 11/2005 |

* cited by examiner

*Primary Examiner* — Liam McDowell
(74) *Attorney, Agent, or Firm* — Keating & Bennett, LLP

(57) ABSTRACT

A fan includes an impeller having a plurality of blades. Each of the plurality of blades has a trailing edge portion positioned rearmost in a rotation direction and a leading edge portion positioned foremost in the rotation direction. A curved line interconnects the trailing edge portion and the leading edge portion at the shortest distance on an imaginary cylindrical surface. Each of the blades includes a lower surface facing downward in the direction of the center axis and an upper surface facing upward in the direction of the center axis. In the fan, L1/L2 decreases from a radial inner side toward a radial outer side, where L1 denotes the longest distance on the imaginary cylindrical surface between the curved line and a camber line and L2 denotes a length of the curved line.

6 Claims, 5 Drawing Sheets

AXIAL FLOW FAN

BACKGROUND OF THE INVENTION

1. Field of the Invention

The present invention relates to an axial flow fan.

2. Description of the Related Art

Fans have been used to circulate a cold air within a freezer or a refrigerator. In a blower fan for feeding a cooling air to a heat source, it is necessary to feed the cooling air to the heat source as much as possible. For that reason, it is desirable that the cooling air fed from the blower fan be concentrated on the heat source as far as possible. In the meantime, internal cold air needs to be stirred in case of an internal-circulation-purpose blower fan. An increased air flow rate is required in order to stir the cold air. Many different proposals have been made to increase the air flow rate. For example, Japanese Patent Application Publication No. 2002-21798 (JP2002-21798A) discloses a fan structure in which blades 55 are arranged to protrude axially outward of a fan housing 57 so that the blades 55 can be positioned higher than the upper surface of the fan housing 57 by a specified height P. In this structure, when air is introduced at the side of the upper surface, the air introduced from the lateral side can be increased by the protruding height P of the blades 55. Thus, the intake air flow rate increases.

Most modern home appliances are required to consume a reduced amount of electric power. This holds true in case of a refrigerator and a freezer. Accordingly, low power consumption is required in a blower fan arranged within a refrigerator or a freezer. In other words, there is a need to enhance the efficiency of a blower fan. A blower fan arranged within a refrigerator or a freezer is required to draw and discharge an increased amount of air. In light of this, as disclosed in JP2002-21798A, a blower fan arranged within a refrigerator or a freezer seeks to increase intake air flow rate by using a structure in which blades are positioned higher than the upper surface of a fan housing by a specified height. In this case, the projection area of the blades in the rotation direction becomes larger, which leads to an increased windage loss. The windage loss needs to be reduced in order to enhance the efficiency of the blower fan.

SUMMARY OF THE INVENTION

One of the preferred embodiments of the present invention provides a fan including: a motor; and an impeller including a plurality of blades, the impeller being rotated by the motor about a center axis to generate airflow, wherein the motor includes a stationary unit and a rotor unit arranged to rotate with respect to the stationary unit; the impeller includes a substantially cylindrical impeller holder portion fixed to the rotor unit; the blades extend radially outward from an outer surface of the impeller holder portion; each of the blades includes a trailing edge portion positioned rearmost in a rotation direction and a leading edge portion positioned foremost in the rotation direction; and on a cross section of each of the blades intersecting an imaginary cylindrical surface of arbitrary diameter about the center axis, L1/L2 decreases from a radial inner side toward a radial outer side, where L1 denotes the longest distance on the imaginary cylindrical surface between a curved line interconnecting the trailing edge portion and the leading edge portion at the shortest distance on the imaginary cylindrical surface and a camber line equally spaced apart from a lower surface of each of the blades facing downward in the direction of the center axis and from an upper surface of each of the blades facing upward in the direction of the center axis, and L2 denotes a length of the curved line.

With the preferred embodiments of the present invention, it is possible to reduce the windage loss caused by the rotation of blades while maintaining an air flow rate. It is also possible to reduce power consumption in a blower fan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
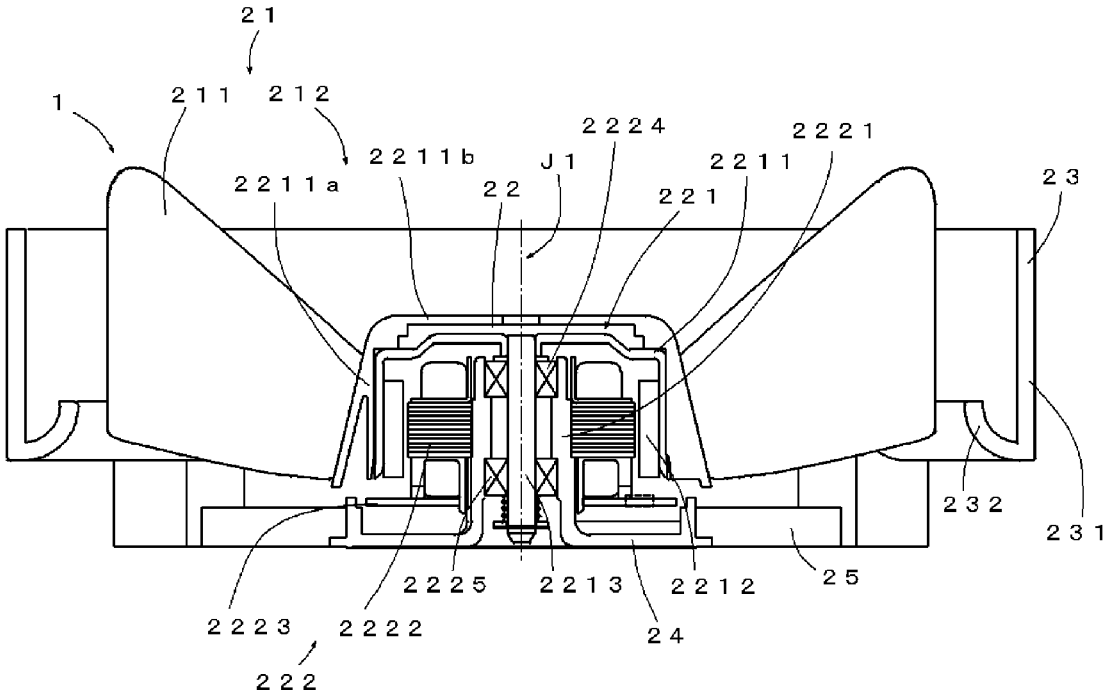
FIG. 1 is a vertical section view showing an axial flow fan 1 according to a preferred embodiment of the present invention.

FIG. 1 is a vertical section view showing an axial flow fan 1 according to one preferred embodiment of the present invention. The axial flow fan 1 is preferably used as, e.g., an air-circulation-purpose blower fan within a refrigerator or a freezer.

In the axial flow fan 1, an air is drawn from the upper side in FIG. 1 and is discharged toward the lower side, thereby generating airflow in the direction extending in the direction of the center axis J1. In the following description, the air drawing side in the direction of the center axis J1, i.e., the upper side in FIG. 1, will be referred to as "upper side" or "intake side". The air discharging side, i.e., the lower side in FIG. 1, will be referred to as "lower side" or "exhaust side". The expressions "upper side" and "lower side" need not necessarily conform to the upper side and the lower side in the gravitational direction.

The axial flow fan 1 preferably includes an impeller 21, a motor 22, and a housing 23. The motor 22 generates airflow by rotating the impeller 21 about the center axis J1. The housing preferably is a tubular housing surrounding the outer circumference of the impeller 21.

The impeller 21 preferably includes a substantially cylindrical closed-top impeller holder portion 212 covering the motor 22 and a plurality of blades 211 extending radially outward about the center axis J1 from the outer surface of the impeller holder portion 212. The blades 211 are preferably arranged at an equal pitch in the circumferential direction about the center axis J1. The motor 22 preferably includes a rotor unit 221 as a rotating body and a stationary unit 222 as a fixed body. The impeller holder portion 212 is fixed to the rotor unit 221. The impeller holder portion 212 preferably includes a cylinder portion 2211*a* fixed to the outer circumferential surface of the rotor unit 221 and a cover portion 2211*b* covering the upper surface of the rotor unit 221. Alternatively, the impeller holder portion 212 may not include the cover portion 2211*b* but may include only the cylinder portion 2211*a* if so desired. The rotor unit 221 is positioned above the stationary unit 222 in the direction of the center axis J1. The rotor unit 221 is arranged to rotate with respect to the stationary unit 222.

The rotor unit 221 preferably includes a substantially cylindrical closed-top metal yoke 2211 arranged about the center axis J1, a substantially cylindrical field magnet 2212 fixed to the inner surface of the yoke 2211 and a shaft 2213 protruding downward from the upper central portion of the yoke 2211. The impeller holder portion 212 is arranged to cover the yoke 2211. The impeller 21 is attached to the rotor unit 221.

The stationary unit 222 preferably includes a substantially cylindrical base portion 24, a substantially cylindrical bearing retainer portion 2221 protruding upward from the center of the base portion 24, a stator 2222 attached to the outer circumference of the bearing retainer portion 2221, and a circuit board 2223 arranged below the stator 2222 and electrically connected to the stator 2222. The base portion 24 is arranged below the impeller 21 in the direction of the center axis J1 and is connected to the housing 23 by support ribs 25. The support ribs 25 are preferably rod-shaped portions extending outward from the radial inner side and are circumferentially arranged about the center axis J1. The stator 2222 is opposed to the field magnet 2212 in the radial direction about the center axis J1 (hereinafter just referred to as "radial direction"). Torque acting about the center axis J1 is generated between the stator 2222 and the field magnet 2212. In FIG. 1, an outer-rotor-type motor in which the field magnet is arranged radially outward of the stator is illustrated. Alternatively, it is also possible to provide an inner-rotor-type motor in which the field magnet is arranged radially inward of the stator, if so desired. Within the bearing retainer portion 2221, ball bearings 2224 and 2225 are provided as a bearing mechanism at the upper side and the lower side along the center axis J1. The shaft 2213 inserted into the bearing retainer portion 2221 is rotatably supported by the ball bearings 2224 and 2225. While the ball bearings are preferably included in the present preferred embodiment, it may be advisable to include other bearing devices, such as, for example, a plane bearing in which a shaft is supported by an oil-containing sintered cylindrical sleeve. That is, the configuration of the bearings is not specifically limited to the ball bearings discussed above.

Figure 2:
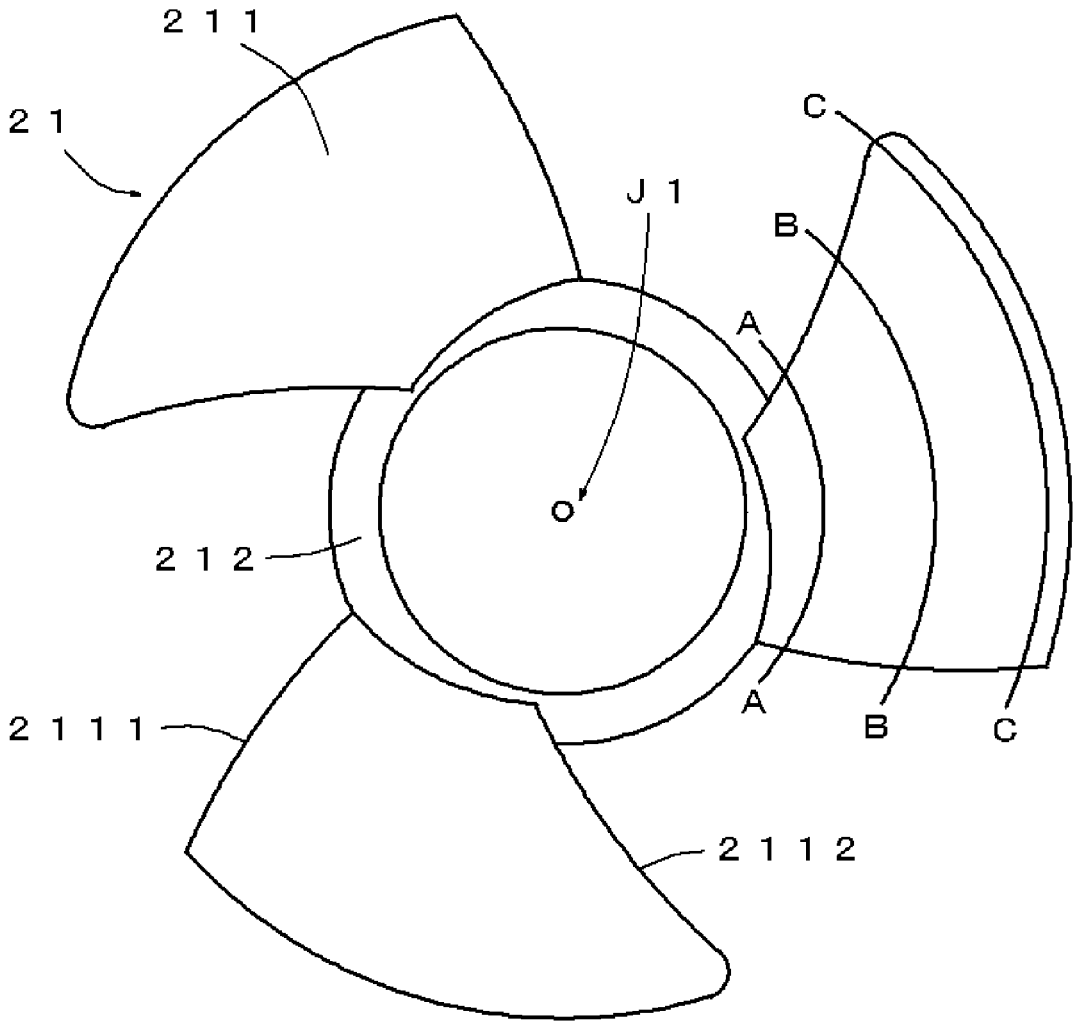
FIG. 2 is an axial top plan view showing an impeller employed in the axial flow fan 1 according to a preferred embodiment of the present invention.

Next, a description of the blades 211 will be provided. FIG. 2 is an axial top plan view showing the impeller 21 included in the axial flow fan 1 according to a preferred embodiment of the present invention. The impeller 21 rotates counterclockwise in FIG. 2 about the center axis J1. The blades 211 extend radially outward from the outer surface of the impeller holder portion 212. Each of the blades 211 preferably includes a leading edge portion 2112 inclined upward along the center axis J1 as it extends outward from the radial inner side. The radial inner end of each leading edge portion 2112 is positioned lower than the upper end of the impeller holder portion 212. The radial outer end of each leading edge portion 2112 is positioned higher than the upper end of the impeller holder portion 212. As shown in FIG. 1, the radial outer end of each of the blades 211 (the radial outer end of the leading edge portion 2112) protrudes axially upward beyond the upper end of the housing 23. The blades 211 are preferably circumferentially arranged at an equal interval about the center axis J1. In the present preferred embodiment, the impeller 21 preferably includes three blades 211, for example. As shown in FIG. 2, when seen in a plan view, a trailing edge portion 2111 and the leading edge portion 2112 are inclined forward in the rotation direction of the impeller 21 as they extend outward from the radial inner side. In the circumferential direction of the outer circumferences of the blades 211, the ratio of the distance between the adjoining blades 211 to the outer arc length of each of the blades 211 is preferably, e.g., about 10:7. If the distance between the adjoining blades 211 becomes longer, the air flow rate increases and the static pressure decreases. On the other hand, if the distance between the adjoining blades 211 becomes shorter, the air flow rate decreases and the static pressure increases. The ratio stated above varies depending on the intended use of the fan. If the fan is arranged within a freezer or a refrigerator and is used for air circulation purposes, it is preferred that the ratio be about 10:7, for example.

Figure 3:
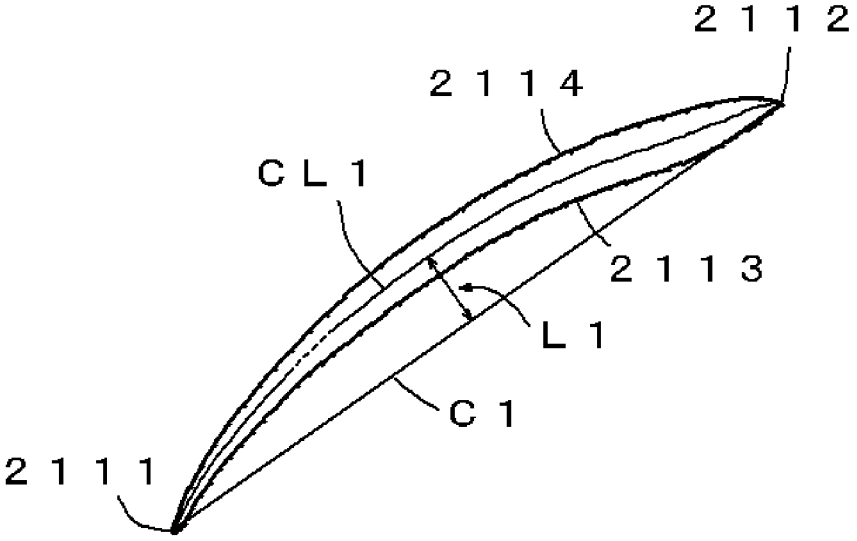
FIG. 3 is a section view taken along line A-A in FIG. 2.
Figure 4:
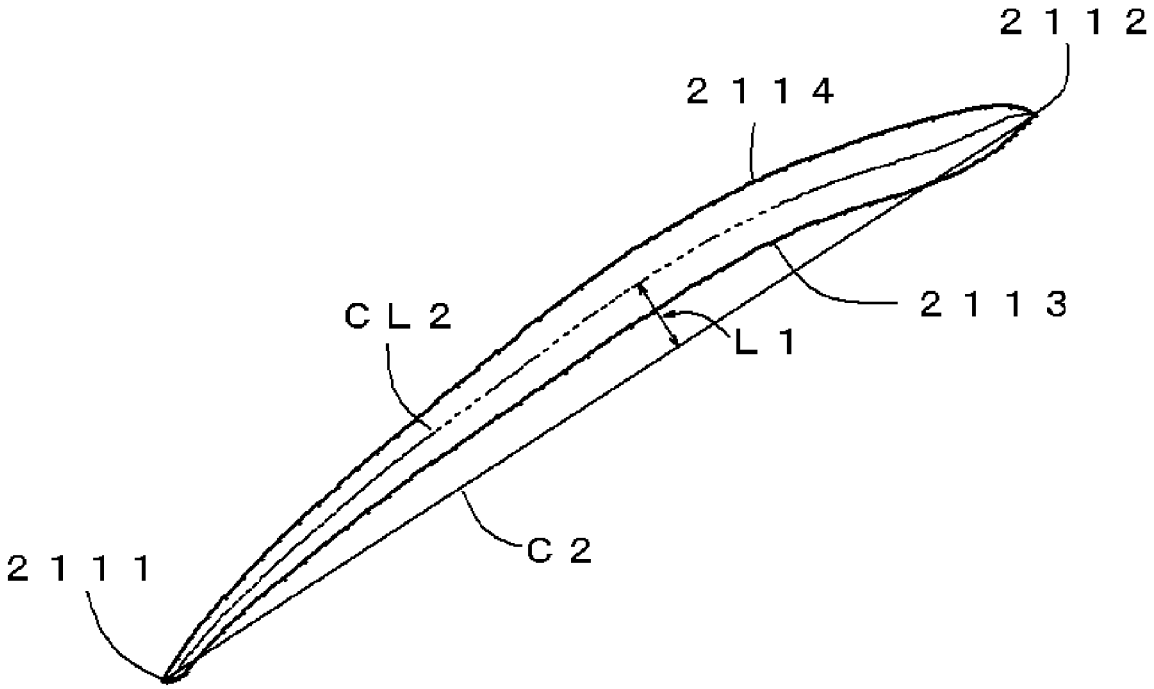
FIG. 4 is a section view taken along line B-B in FIG. 2.
Figure 5:
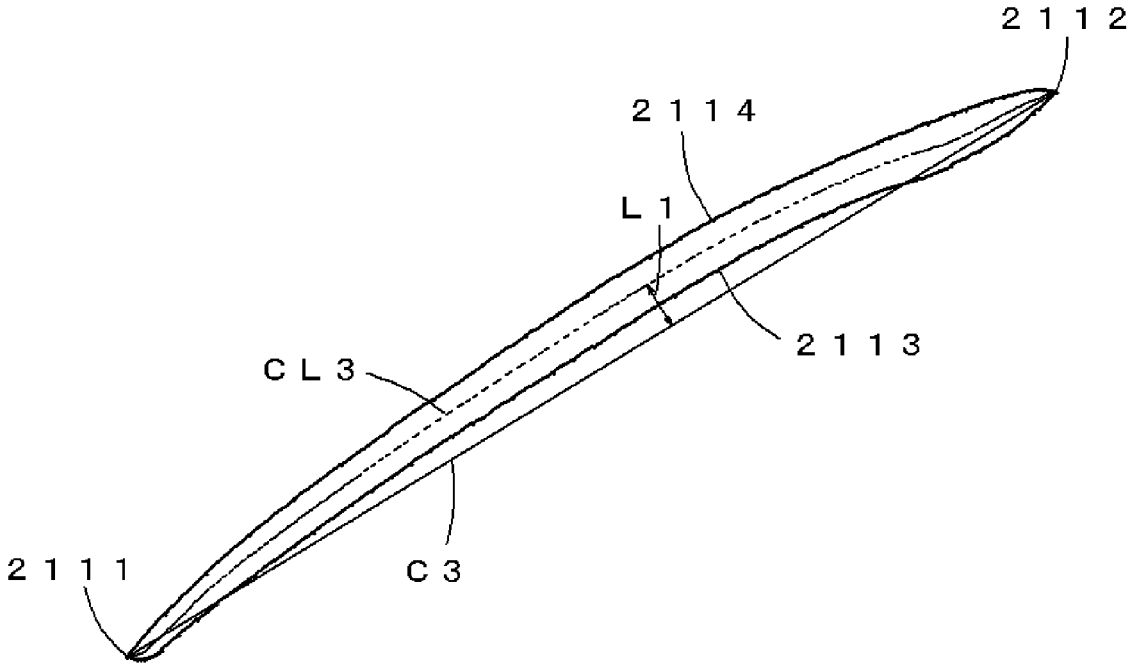
FIG. 5 is a section view taken along line C-C in FIG. 2.

The cross section line A-A in FIG. 2 shows a portion of an imaginary cylindrical surface A in an arbitrary radial position about the center axis J1. The cross section line B-B in FIG. 2 shows a portion of an imaginary cylindrical surface B larger in diameter than the imaginary cylindrical surface A. The cross section line C-C in FIG. 2 shows a portion of an imaginary cylindrical surface C larger in diameter than the imaginary cylindrical surface B but smaller in diameter than the outermost diameter of each of the blades. FIGS. 3 to 5 are section views taken along lines A-A, B-B, and C-C, respectively.

The cross section of each of the blades 211 will now be described with reference to FIG. 3. As shown in FIGS. 2 and 3, each of the blades 211 preferably includes a trailing edge portion 2111 positioned at a rearmost position in the rotation direction and a leading edge portion 2112 positioned at the foremost in the rotation direction. A curved line C1 indicates the line interconnecting the trailing edge portion 2111 and the leading edge portion 2112 at the shortest distance along the imaginary cylindrical surface A. It is noted that the curve line C1 has a curved shape in reality while it looks like a straight line in FIG. 3. The reason is that the curved cross section taken in the intersecting position of the imaginary cylindrical surface A and each of the blades 211 is developed into a planar surface. Likewise, curved lines C2 and C3, to be described later, have curved shapes in reality while they are depicted as straight lines in the drawings. Each of the blades 211 preferably includes a lower surface 2113 facing downward in the direction of the center axis J1 and an upper surface 2114 facing upward in the direction of the center axis J1. In FIG. 3, CL1 denotes a camber line equally spaced apart from the lower surface 2113 and the upper surface 2114. L1 signifies the longest distance from the curved line C1 to the camber line CL1. More specifically, L1 indicates the longest distance among distances between the points at which straight lines perpendicular to the curved line C1 intersect the curved line C1 and the camber line CL1. As stated above, FIG. 3 is a view obtained by developing the curved cross section into a planar surface. Therefore, in reality, L1 is the longest curved distance between the curved line C1 and the camber line CL1 on the imaginary cylindrical surface. Assuming that the length of the curved line C1 is L2, the value of L1/L2 decreases from the radial inner side toward the radial outer side as shown in FIGS. 3 through 5. In other words, the camber amount of the camber line CL1 on the blade cross section decreases from the radial inner side toward the radial outer side. Similarly in FIGS. 4 and 5, CL2 and CL3 denote camber lines equally spaced apart from the lower surface 2113 and the upper surface 2114.

If the value of L1/L2 is small, the air can smoothly pass through the lower surface 2113. This makes it possible to reduce a windage loss. On the other hand, if the value of L1/L2 is large, the airflow can be heavily changed downward. This helps increase the air flow rate. However, the change of the airflow applies load to the blades 211, consequently causing a windage loss. The blades 211 rotate about the center axis J1, thereby compressing the air downward. Due to the centrifugal force generated by the rotation of the blades 211, however, the flow velocity of the air has a centrifugal component that is not perpendicular to the center axis J1. In other words, the air passing through the leading edge portion 2112 moves radially outward as it flows downward along the lower surface 2113. Accordingly, the amount of the air passing through the lower surface 2113 of each of the blades 211 increases toward the radial outer side. In other words, each of the blades 211 works harder in the radial outer region thereof than in the radial inner region. Accordingly, if the windage loss can be reduced in the radial outer region of each of the blades 211, it becomes possible to reduce the electric power consumed by the axial flow fan 1.

As shown in FIGS. 3 and 4, the camber position of L1 is shifted toward the leading edge portion 2112 as each of the blades extends from the radial inner side to the radial outer side. In this regard, the camber position means the position in the direction parallel to the curved line C1. Accordingly, the air passing through the leading edge portion 2112 in the radial inner region flows through the region between the camber position of L1 and the trailing edge portion 2111 when moving toward the radial outer side. This makes it possible to reduce the windage loss.

Referring to FIG. 5, the leading edge portion 2112 preferably defines an angle of about 17° to about 19°, for example, with respect to the plane perpendicular to the center axis J1 at the intersection point of the camber line CL3 with the leading edge portion 2112. The term "radial outer region" refers to the region lying radially outward of the radial center of each of the blades 211.

As shown in FIG. 1, the trailing edge portion 2111 is preferably inclined upward in the direction of the center axis J1 as it extends from the radial inner side toward the radial outer side. As set forth above, the air passing through the leading edge portion 2112 flows radially outward along the lower surface 2113 under the influence of a centrifugal force. Thus the amount of the air passing through the trailing edge portion 2111 is larger at the radial outer side than at the radial inner side. The air compressed downward passes through the regions near the support ribs 25, thereby generating a sound caused by the interference with the support ribs 25. Use of the configuration described above makes it possible to increase the gap between the support ribs 25 and the trailing edge portion 2111 in the direction of the center axis J1.

Next, description will be made on the housing 23. The housing 23 preferably includes a housing cylinder portion 231 surrounding the impeller 21 at the radial outer side and an arc-shaped orifice 232 extending radially inward from the lower end of the housing cylinder portion 231. The orifice 232 is preferably radially opposed to the radial outer ends of the blades 211. The orifice 232 enables the air to smoothly pass along the inner circumferential surface thereof. This makes it possible to prevent or substantially prevent the air from flowing backward and to increase the static pressure of the axial flow fan 1.

The fan 1 of the present preferred embodiment can preferably be used, for example, for air circulation purposes and for stirring purposes in devices other than a freezer or a refrigerator.

While the invention has been shown and described with respect to the preferred embodiments, the present invention is not limited thereto. It will be understood by those skilled in the art that various changes and modifications may be made without departing from the scope of the invention as defined in the following claims.

What is claimed is:

1. A fan, comprising:

a motor; and an impeller including a plurality of blades, the impeller being rotated by the motor about a center axis to generate airflow; wherein the motor includes a stationary portion and a rotor portion arranged to rotate with respect to the stationary portion;

the impeller includes a substantially cylindrical impeller holder portion fixed to the rotor unit;

the blades extend radially outward from an outer surface of the impeller holder portion;

each of the blades includes a trailing edge portion positioned rearmost in a rotation direction and a leading edge portion positioned foremost in the rotation direction;

on a cross section of each of the blades intersecting an imaginary cylindrical surface of an arbitrary diameter about the center axis, L1/L2 decreases from a radial inner side toward a radial outer side, where L1 denotes a longest distance on the imaginary cylindrical surface between a curved line interconnecting the trailing edge portion and the leading edge portion at a shortest distance on the imaginary cylindrical surface and a camber line equally spaced apart from a lower surface of each of the blades facing downward in the direction of the center axis and from an upper surface of each of the blades facing upward in the direction of the center axis, and L2 denotes a length of the curved line; and a camber position of L1 is shifted toward the leading edge portion as each of the blades extends from the radial inner side to the radial outer side.

2. The fan of claim 1, wherein the leading edge portion defines an angle of about 17° to about 19° with respect to a plane perpendicular to the center axis at a radial outer end of each of the blades.

3. The fan of claim 1, wherein the trailing edge portion is inclined upward in the direction of the center axis as the trailing edge portion extends from the radial inner side toward the radial outer side.

4. The fan of claim 1, wherein the leading edge portion is inclined upward in the direction of the center axis as the leading edge portion extends from the radial inner side toward the radial outer side, the leading edge portion including a radial inner end positioned lower than an upper end of the impeller holder portion and a radial outer end positioned higher than the upper end of the impeller holder portion.

5. The fan of claim 1, wherein, when seen in a plan view, the trailing edge portion and the leading edge portion are inclined forward in the rotation direction as the trailing edge portion and the leading edge portion extend from the radial inner side toward the radial outer side.

6. The fan of claim 1, further comprising:

a housing arranged to surround the impeller at the radial outer side, the leading edge portion protruding axially upward beyond an upper end of the housing at the radial outer side.

* * * * *